US006589084B1

(12) United States Patent
Frank

(10) Patent No.: US 6,589,084 B1
(45) Date of Patent: Jul. 8, 2003

(54) DEVICE FOR PLUG-CONNECTING ELECTRIC LINES

(75) Inventor: Erich Walter Frank, Hochdorf (DE)

(73) Assignee: Pfisterer Kontaktsysteme GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/070,548

(22) PCT Filed: Sep. 8, 2000

(86) PCT No.: PCT/EP00/08795

§ 371 (c)(1),
(2), (4) Date: Mar. 7, 2002

(87) PCT Pub. No.: WO01/18913

PCT Pub. Date: Mar. 15, 2001

(30) Foreign Application Priority Data

Sep. 9, 1999 (DE) ..... 199 43 045

(51) Int. Cl.[7] ..... H01R 13/15
(52) U.S. Cl. ..... 439/839; 439/620
(58) Field of Search ..... 439/620, 839, 439/358

(56) References Cited

U.S. PATENT DOCUMENTS 3,745,514 A * 7/1973 Brishka ..... 439/839
4,219,252 A 8/1980 Fischer
4,395,081 A 7/1983 Melys
5,197,908 A * 3/1993 Nelson ..... 439/839
5,916,002 A * 6/1999 Gottschalk et al. ..... 439/839
5,938,486 A * 8/1999 Durand-Cochet et al. ... 439/839
6,375,510 B2 * 4/2002 Asao ..... 439/620

FOREIGN PATENT DOCUMENTS

DE 1809183 9/1960

* cited by examiner

*Primary Examiner*—Gary Paumen
(74) *Attorney, Agent, or Firm*—Roylance, Abrams, Berdo & Goodman, LLP

(57) ABSTRACT

A device for plug-connecting first and second electric lines includes a plug element assigned to the first line and having a plug pin. A socket element is assigned to the second line and receives the plug pin in a pin receiver for electrically contact. The socket element has a metal strip forming the second line. On its end facing the plug pin, the metal strip is deformed in a transversal manner with regard to its longitudinal direction while forming the plug receiver. The metal strip is deformed so that the plug pin can be inserted into the plug receiver in a longitudinal direction of the metal strip. Also, the metal strip forms a one-piece plate bar located external to the socket element. Electrical and/or electronic components are applied to the plate bar, and are electrically connected in an at least partial manner to the metal strip.

26 Claims, 3 Drawing Sheets

DEVICE FOR PLUG-CONNECTING ELECTRIC LINES

FIELD OF THE INVENTION

The present invention relates to a device for plug-connection of first and second electric conductors. A plug element has a plug pin associated with the first conductor. A socket element has a socket element associated with the second conductor which receives the plug pin into a pin receptacle to make electric contact.

BACKGROUND OF THE INVENTION

In conventional plug connection devices, the plug and socket elements must be fastened to the electric conductors associated with them to establish electric contact. As a result, additional contact points arise which present a potential source of malfunction under more difficult operating conditions such as vibrations or aggressive atmospheres. Structural precautions must be taken so that both the plug and the socket elements ensure reliable contact, especially in the area of the contact points. In addition, the socket element is time consuming and costly to manufacture.

DE-GM 1 809 183 discloses a device providing a plug connection between two electrical conductors for low currents in the area of electric information transmission and metrology. The device is connected electrically to connecting conductors by means of the solder connections making up the device, similar to those specified in DE 20 41 065 B2.

U.S. Pat. No. 4,219,252 shows an electric plug connector which forms in the socket area two clamping jaws made up of metal strips. The ends of the metal strips away from the socket are separated in the form of a stirrup to provide electric contact for the socket element.

DE-GM 1 933 165 discloses a one-piece contact spring with two spring halves which are stamped from a metal sheet and then folded together. Electric connection with the connecting conductor is established by a soldered end formed by the contact spring.

DE 79 15 670 U1 describes an electric strip connector with a base area to which at least one finger area, a wire rope coupling, and a connecting element are connected.

U.S. Pat. No. 4,395,081 discloses a plug connector with a socket element designed as a cable lug which may be connected to a grounding plate. For this purpose, the socket element is integral and has two contact prongs directly on the grounding plate.

SUMMARY OF THE INVENTION

Objects of the present invention are to provide a device for plug connection of a first electric conductor to a second electric conductor with a plug element associated with the first conductor and a socket element associated with the second conductor. The contact may be established with electric and/or electronic components mounted on a bar and have the smallest possible number of failure-prone contact points, while at the same time ensuring contact protection despite simplicity of manufacture.

The socket element has a metal strip forming the second conductor. The end of the metal strip is shaped and, in particular, is bent transversely to the longitudinal direction of the strip to form the pin receptacle such that the plug pin may be inserted into the plug receptacle in the longitudinal direction of the metal strip. The second conductor and the socket element are designed as one piece. A contact point between the second conductor and the socket element is eliminated. The pin receptacle has, in a cross-section enclosing a right angle with the longitudinal axis of the metal strip, a shape more or less coinciding with the corresponding cross-section of the plug pin. The plug pin is, for example, in the form of a circular cylinder and, like the pin receptacle, designed for a current carrying capacity of 1 to 1000 A, preferably 50 to 200 A. The metal strip is preferably made of copper or a copper alloy, and preferably has a thickness ranging from 0.5 to 2 mm.

As a result of formation of the pin receptacle by bending the metal strip transversely to the longitudinal direction of the strip, the pin receptacle has a high flexural strength, especially in the direction of insertion of the plug pin. The longitudinal direction of the metal strip is more or less parallel to the direction of insertion of the plug pin. The metal strip is, in the area of the pin receptacle, at least partly bent around the central axis of the device. As a result, it is easy to design the socket element as a panel jack mounted on a housing, or integral with the housing or the perforation to be provided for the metal strip or the second conductor.

In the present invention, the metal strip forms a bar outside the socket or plug element, as one piece. On the bar, the components of an electric or electronic appliance are mounted, such as those of an electronic frequency converter for a motor and/or generator appliance. This arrangement eliminates the need for additional contact and connecting points. Reliable operation is achieved with reduced manufacturing and assembly costs. Several metal plates making up a pin receptacle for a socket element per layer may form an overall multilayer bar. The individual layers are electrically insulated from each other. The electric and/or electronic components mounted on the bar may be electrically connected to one or more of the layers, and thus, to one or more of the pin receptacles.

The reliability of contact and the current carrying capacity of the pin receptacle is increased by the socket element having two or more metal strips. The bending radius of the individual metal strips is preferably more or less identical, and in particular smaller than the radius of the plug pin. As a result, the advantage is gained of producing at least two contact points or conductors per metal strip. In addition, the metal strip may have a plurality of punctate conductor or laminar contact points in the area of the pin receptacle which are molded on in one piece and come contact with the plug pin.

Since the at least two metal strips are in one piece, a basically interference-prone electric connecting point is eliminated. As an alternative to the one-piece design of the at least two metal strips, the latter may preferably be mechanically, and optionally also electrically, rigidly connected to each other outside the socket area. Preferably, this connection is bonded, for example, by riveting, soldering, and welding, spot welding in particular, or by flanging of shaped metal tabs. Screw, hook, or catch attachment of the metal strips is also possible, of course. This arrangement permits electrical connection of, for example, two component conductors of the second conductor by the plug connection device. If the connection point of the at least two metal strips provides only a mechanical connection, electrical connection of the at least two metal strips results when the plug element is inserted.

Since the metal strip is or the strips are enclosed in an energy storage fuse element, for example, by one or more clamping rings applying the force of a spring to the metal strips radially, the reliability of contact and current carrying capacity of the pin receptacle are further increased.

Since the pin receptacle is mounted in a preferably electrically insulating socket housing which overlaps the pin receptacle at the end, with an opening left for passage of the plug pin, the socket element is shockproof. The opening for passage of the plug pin is only slightly larger than the plug pin and its shape is adapted to that of the plug pin. The pin receptacle is mounted in the socket element in such a way, and in particular opposite the opening so far, that when a probe is inserted into the opening in accordance with safety regulations, it does not come in contact with the pin receptacle.

Since the socket housing has catch means operating in conjunction with the plug element, the plug connection may be produced by a simple method. In particular it can be made without a special assembly tool. The danger of unintentional contact with the plug pin and/or the pin receptacle is eliminated.

With the plug pin mounted in a plug housing projecting beyond the plug pin in the direction of insertion, a probe does not come in contact with the plug pin when introduced into the plug opening in accordance with safety regulations. In this manner, protection from contact is also guaranteed with respect to the plug element of the plug connecting device. Additional protection from contact is achieved by the plug pin having an electrically insulating end section, preferably produced by means of an electrically insulating sealing element mounted on the end side of the plug pin. Protection from contact is increased and insertion of the plug pin into the pin receptacle is simplified by a sealing element in conical or spherical form on the end side.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
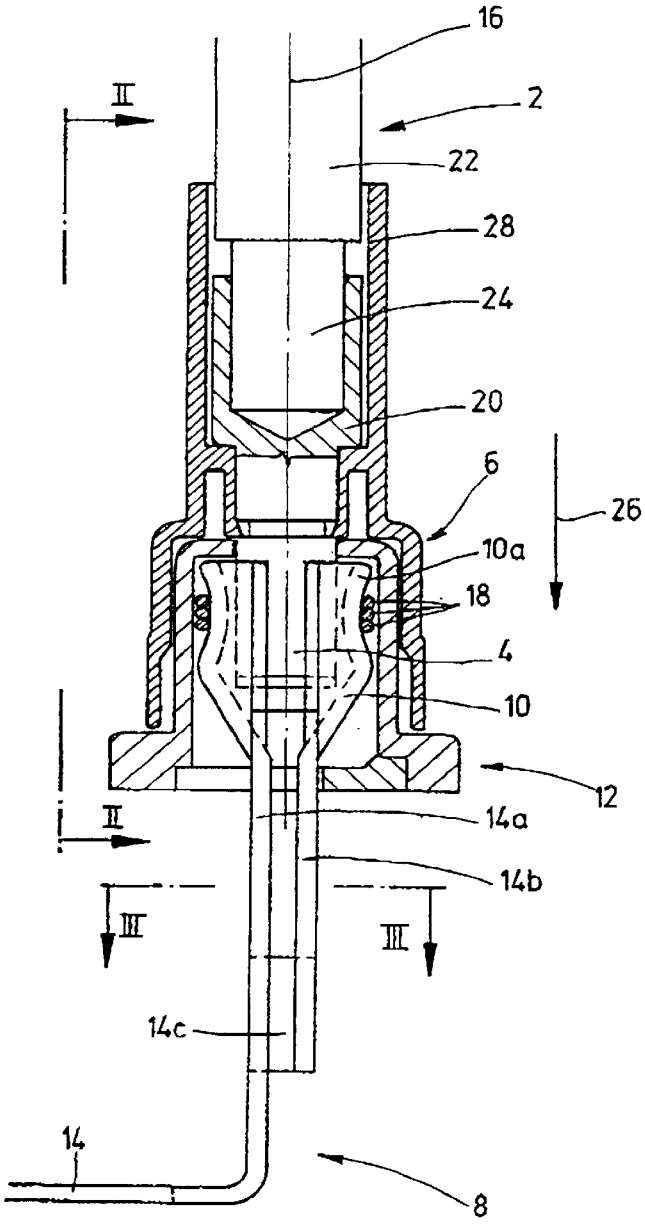
FIG. 1 is a front elevational view in section of a device according to a first embodiment of the present invention.

Fig. 1 shows a device according to the present invention for plug connection, with plug element 6 associated with the first electric conductor 2 and having a plug pin 4. A socket element 12 is associated with the second electric conductor 8 and receives the plug pin 4 in a pin receptacle 10 to establish electric contact.

The socket element 12 comprises two metal strips 14*a* and 14*b* made in the form of a single or unitary piece, which are joined together outside the pin receptacle 10 and which are bent around the central axis 16 of the plug connection device so as to be transverse to their longitudinal direction. On their end facing the plug element 6, the pin receptacle has a widened area 10*a* to make insertion of the plug pin 4 easier. The two metal strips 14*a* and 14*b* are enclosed in the area of the pin receptacle 10 by three spring-loaded safety rings 18. The rings may be formed, for example, of metal or rubber.

The plug pin 4 forms on its reverse side, preferably as a unitary, one piece structure, a receptacle 20 for the conducting wire 24 of the first electric conductor 2. The conducting wire 24 is provided with electric insulation 22. The plug pin 4 is mounted in a plug housing 28 which projects beyond the pin in the direction of insertion 26.

Figure 2:
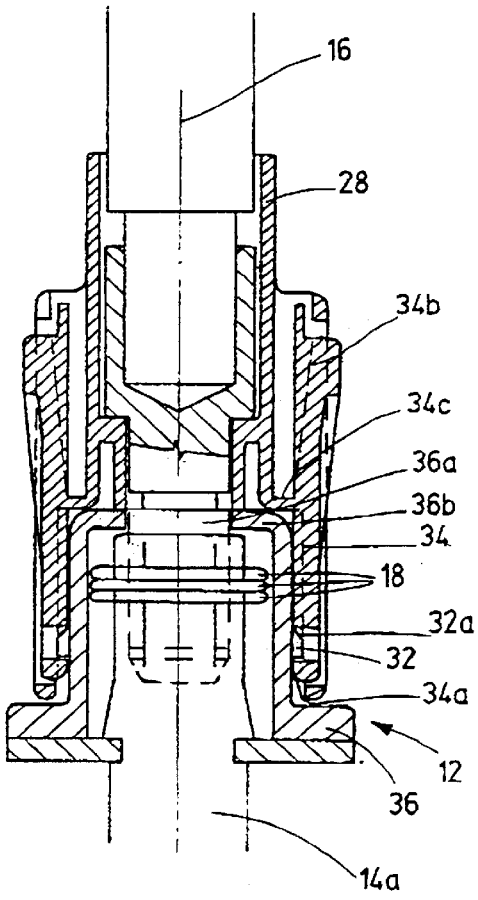
FIG. 2 is a side elevational view in section of the device taken along line II—II of FIG. 1.

FIG. 2 shows a side view of the device illustrated in FIG. 1. Mounted on the socket element 12 on opposite sides relative to the center axis 16 are two detents 32. The detents, together with snap-in pins 34 molded on the plug housing 28, permit an engaging and disengaging lockable connection between the plug housing 28 and the socket element 12. Each of the detents 32 has a stop bevel 32*a*. In conjunction with a chamfer 34*a* on the snap-in pins, stop beval 32*a* simplifies locking in place. The snap-in pins 34 are integral with the plug housing 28 and may be operated by their operating lever 34*b* or may be pivoted around the link 34*c* integral or unitary with the plug housing 28. The pin receptacle 10 is mounted in a socket housing 36 and is overlapped by the latter. An opening 36*a* is left in socket housing 36 for passage of the plug pin 4. The socket housing 36 forms a ring-shaped flange-like surface 36*b* on which the plug housing 28 rests when inserted.

Figure 3:
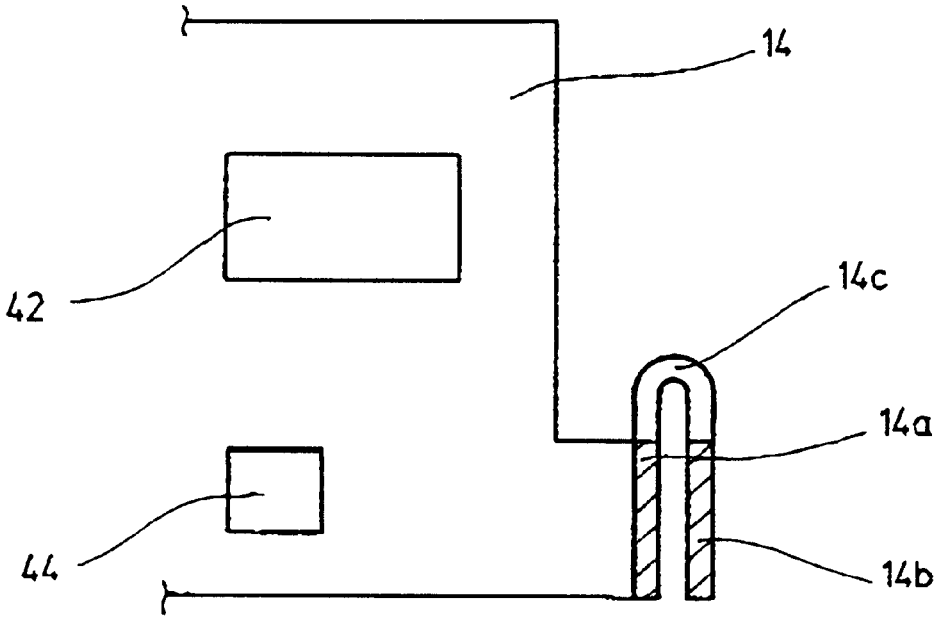
FIG. 3 is a top plan view in section of the device taken along line III—III of FIG. 1.

FIG. 3 shows a cross-sectional view along line III—III of the device illustrated in FIG. 1. The two metal strips 14*a* and 14*b* forming the pin receptacle 10 in FIG. 1 are joined to each other outside the pin receptacle by the connecting piece 14*c*, and in particular are made from a metal sheet to be integral or unitary, in particular by stamping followed by shaping by bending. Outside the socket element 12 shown in FIG. 1, the metal strips 14*a* and 14*b* form a bar 14 on which the electric and/or electronic components 42 and 44 are mounted. The components are joined at least in part with the metal strips 14*a* and 14*b*, and thereby with the first electric conductor 2 through the pin receptacle 10 and the plug pin 4. In this manner bar 14 and metal strips 14*a* and 14*b* form the second conductor 8.

Figure 4:
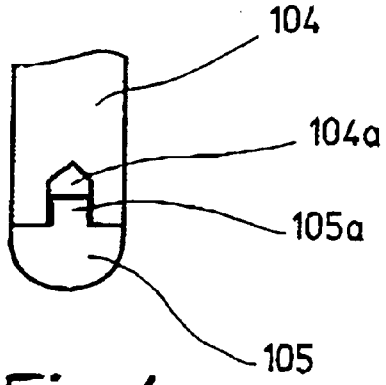
FIG. 4 is a side elevational view of a plug pin according to a second embodiment of the present invention.

FIG. 4 shows an alternative exemplary embodiment of the plug pin 104. On it's the plug pin end facing the pin receptacle 10 (not shown), an electrically insulating sealing element 105 is pressed into a bored hole 104*a* in the plug pin 104 by means of a plug 105*a*. The sealing element 105 is of plastic. Its end is hemispherical in shape. As an alternative or supplement to pressing, the sealing element 105 may be fastened to the plug pin 104 by an adhesive and/or screw(s).

Figure 5:
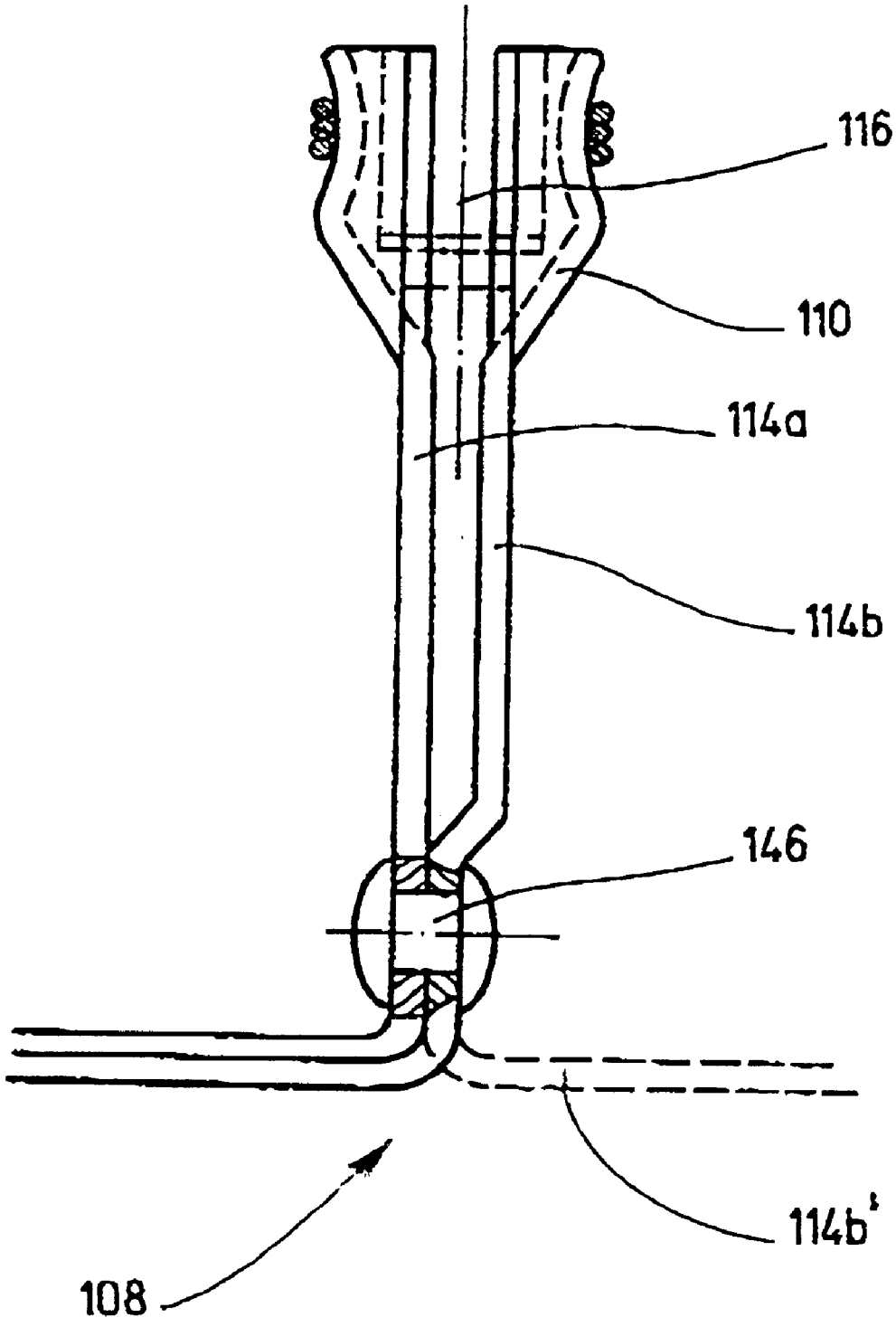
FIG. 5 is a front elevational view in partial section according to a third embodiment of the present invention.

FIG. 5 shows an alternative exemplary embodiment of the metal strip 114*a*, 114*b* for the socket element. The two metal strips 114*a* and 114*b* form a first part conductor and a second part conductor of the second electric conductor 108. Outside the area of the pin receptacle 110, the metal strips are electrically and mechanically rigidly and inseparably joined to each other, in the exemplary embodiment illustrated, by a rivet 146 extending transversely to axis 116. The two part conductors of the second conductor 108 may, for example, be the connecting leads of in-phase motor windings. Beyond the rivet 146, they may be conducted away at an angle together or (as indicated by broken lines) the second metal strip 114*b*' may be conducted away from the plug connection device in a direction different from that of the first metal strip 114*a*. As an alternative or supplement to use of the rivet 146, the two metal strips 114*a* and 114*b* may be joined by means of any suitable connection technology, a mechanical connection generally being also accompanied by an electric connection. The two metal strips 114*a*, 114*b* in this instance preferably are formed of identical materials and have corresponding dimensions, especially with respect to strip thickness.

While various embodiments have been chosen to illustrate the invention, it will be understood by those skilled in the art that various changes and modifications can be made therein without departing from the scope of the invention as defined in the appended claims.

What is claimed is:

1. A device for a plug connection of first and second conductors, comprising:

a plug element having a plug pin and being connectable to a first conductor; and a socket element having a pin receptacle receiving said plug pin to establish electrical contact therebetween and having a first metal strip forming the second conductor, said metal strip being shaped transversely relative to a longitudinal direction of said plug element and said socket element to form said pin receptacle adjacent one end thereof such that said plug pin can be inserted into said pin receptacle in said longitudinal direction, said metal strip having a bar formed as one piece thereof outside of said socket element on which electric or electronic components can be mounted and electrically connected, at least in part to said metal strip.

2. A device according to claim 1 wherein said socket element comprises a second metal strip joined with said first metal strip outside said pin receptacle, said metal strips being bent substantially in a partially circular shape.

3. A device according to claim 2 wherein said first and second metal strips are unitary.

4. A device according to claim 2 wherein said first and second strips are rigidly joined outside of said pin receptacle.

5. A device according to claim 3 wherein said metal strip, adjacent to said pin receptacle, is contained in a power storage fuse element.

6. A device according to claim 1 wherein said pin receptacle is mounted in a socket housing having an end side overlapping said pin receptacle, said end side having an opening for passage of said plug pin.

7. A device according to claim 6 wherein said socket housing has a first catch which mates with a second catch on said plug element to releaseably engage said plug element with said socket housing.

8. A device according to claim 1 wherein said plug pin is mounted in a plug housing projecting axially beyond said plug pin in a direction of plug pin insertion into said pin receptacle.

9. A device according to claim 1 wherein said plug pin comprises an insulating end section.

10. A device according to claim 9 wherein said end section comprises a sealing element mounted in an end of said plug pin.

11. A device according to claim 10 wherein said sealing element tapers on a free end thereof.

12. A device according to claim 10 wherein said sealing element has a conical free end.

13. A device according to claim 10 wherein said sealing element has a spherical free end.

14. A device for a plug connection of first and second conductors, comprising:

a socket element having a pin receptacle and being connectable to a first conductor; and a plug element having a plug pin received in said pin receptacle to establish electrical contact therebetween and having a first metal strip forming the second conductor, said metal strip being shaped transversely relative to a longitudinal direction of said plug element and said socket element to form said plug pin adjacent one end thereof such that said plug pin can be inserted into said pin receptacle in said longitudinal direction, said metal strip having a bar formed as one piece thereof outside of said plug pin on which electric or electronic components can be mounted and electrically connected, at least in part to said metal strip.

15. A device according to claim 14 wherein said plug element comprises a second metal strip joined with said first metal strip outside said plug pin, said metal strips being bent substantially in a partially circular shape.

16. A device according to claim 15 wherein said first and second metal strips are unitary.

17. A device according to claim 15 wherein said first and second strips are rigidly joined outside of said plug pin.

18. A device according to claim 14 wherein said metal strip, adjacent to said plug pin receptacle, is contained in a power storage fuse element.

19. A devise according to claim 14 wherein said pin receptacle is mounted in a socket housing having an end side overlapping said pin receptacle, said end side having an opening for passage of said plug pin.

20. A device according to claim 19 wherein said socket housing has a first catch which mates with a second catch on said plug element to releaseably engage said plug element withsaid socket housing.

21. A device according to claim 14 wherein said plug pin is mounted in a plug housing projecting axially beyond said plug pin in a direction of plug pin insertion into said pin receptacle.

22. A device according to claim 14 wherein said plug pin comprises an insulating end section.

23. A device according to claim 14 wherein said end section comprises a sealing element mounted in an end of said plug pin.

24. A device according to claim 23 wherein said sealing element tapers on a free end thereof.

25. A device according to claim 23 wherein said sealing element has a conical free end.

26. A device according to claim 23 wherein said sealing element has a spherical free end.

* * * * *